US005660479A

United States Patent [19]

May et al.

[11] Patent Number: 5,660,479

[45] Date of Patent: Aug. 26, 1997

[54] EASY OPEN PACKAGE HEADER

[75] Inventors: Timothy J. May, Greenville; Richard G. Custer; Catherine E. Kettner, both of Appleton; Wendy S. Nichols, Waupaca, all of Wis.

[73] Assignee: Reynolds Consumer Products Inc., Appleton, Wis.

[21] Appl. No.: 602,390

[22] Filed: Feb. 16, 1996

[51] Int. Cl.[6] ..... B65D 33/24

[52] U.S. Cl. ..... 383/204; 383/61; 383/63; 383/202

[58] Field of Search ..... 383/9, 61, 63, 383/202, 203, 204; 428/43

[56] References Cited

U.S. PATENT DOCUMENTS

| | | | |
|---|---|---|---|
| 3,069,066 | 12/1962 | Peckham | 383/209 |
| 3,186,628 | 6/1965 | Rohde | 383/207 |
| 3,226,787 | 1/1966 | Ausnit | 24/201 |
| 3,249,288 | 5/1966 | Repko | 229/66 |
| 3,272,424 | 9/1966 | Rodkey | 229/66 |
| 3,368,740 | 2/1968 | Rohde | 229/66 |
| 3,417,675 | 12/1968 | Ausnit | 93/35 |
| 3,473,589 | 10/1969 | Gotz | 383/61 |
| 3,616,990 | 11/1971 | Powell | 383/209 |
| 3,625,270 | 12/1971 | Skendzic | 150/3 |
| 3,780,781 | 12/1973 | Uramoto | 383/204 |
| 3,827,472 | 8/1974 | Uramoto | 150/3 |
| 4,226,330 | 10/1980 | Butler | 206/620 |
| 4,229,407 | 10/1980 | Craig | 264/519 |
| 4,301,925 | 11/1981 | Bogart | 206/616 |
| 4,337,862 | 7/1982 | Suter | 206/632 |
| 4,488,647 | 12/1984 | Davis | 206/525 |
| 4,522,854 | 6/1985 | Sharps, Jr. | 428/43 |
| 4,705,174 | 11/1987 | Goglio | 206/632 |
| 4,744,674 | 5/1988 | Nocek | 383/63 |
| 4,786,180 | 11/1988 | Van Erden et al. | 383/61 |
| 4,944,409 | 7/1990 | Busche et al. | 206/632 |
| 5,022,530 | 6/1991 | Zieke | 206/618 |
| 5,036,643 | 8/1991 | Bodolay | 383/61 |
| 5,092,684 | 3/1992 | Weeks | 383/61 |
| 5,100,246 | 3/1992 | La Pierre et al. | 383/204 |
| 5,121,997 | 6/1992 | La Pierre et al. | 383/203 |
| 5,174,659 | 12/1992 | Laske | 383/207 |
| 5,186,543 | 2/1993 | Cochran | 383/203 |
| 5,215,380 | 6/1993 | Custer et al. | 383/61 |
| 5,224,779 | 7/1993 | Thompson et al. | 383/5 |
| 5,238,306 | 8/1993 | Heintz et al. | 383/61 |
| 5,335,997 | 8/1994 | Kanemitsu et al. | 383/63 |
| 5,346,301 | 9/1994 | Scarberry et al. | 383/5 |
| 5,372,428 | 12/1994 | Bruno et al. | 383/5 |
| 5,375,930 | 12/1994 | Tani | 383/206 |
| 5,425,825 | 6/1995 | Rasko et al. | 156/66 |
| 5,445,454 | 8/1995 | Barkhorn | 383/207 |
| 5,468,051 | 11/1995 | May | 383/63 |
| 5,525,363 | 6/1996 | Herber et al. | 383/9 |
| 5,552,202 | 9/1996 | May | 383/61 |
| 5,609,420 | 3/1997 | Palmisano | 383/203 |

*Primary Examiner*—Stephen P. Garbe
*Attorney, Agent, or Firm*—Alan T. McDonald

[57] ABSTRACT

A package header arrangement includes a header with first and second opposing films, a tear bead and a support member. The support member is attached to the first film below the tear bead. The tear bead is disposed between the first and second films. When heat and pressure are applied to the first and second films in proximity to the tear bead, the tear bead scores the first and second films creating a breakable tear bead line. When heat and pressure are applied, the tear bead pushes aside the inner layer of the first and second films, weakening the film along the breakable tear bead line without harming the hermetic seal provided by the films. The breakable tear bead line tears easily because it does not have the tough, flexible inner layer of the films to aid in tear resistance. The breakable tear bead line also provides an even tear along a straight line. The support member provides support while tearing along the breakable tear bead line.

12 Claims, 5 Drawing Sheets

38
36
35
36
24
22
24
26
26
20
14
18
12

10
34
32
16
30
20
14
18
12

10
34
32
26
16
30
20
14
18
26
12

EASY OPEN PACKAGE HEADER

FIELD OF THE INVENTION

The present invention generally relates to package header arrangements for polymeric (plastic) bags and, more particularly, relates to an easily opened package header.

BACKGROUND OF THE INVENTION

In many consumer packaging applications, it is important to prevent air or water or the like from passing out of or into a package containing certain products. This is particularly true with respect to cheese packages, meat packages, and the like, for which the contained product must be kept in a constant environment to prevent spoilage. In order to preserve the product contained within such a package, the periphery of the package must be hermetically sealed.

It is also desirable to provide a convenient and effective way to reseat the package after it has been opened. In this respect, recloseable zipper seals are advantageous. On the other hand, recloseable seals alone provide an opportunity for undesired tampering with the contents of a package. To reduce the opportunity for undetected tampering, packages with recloseable zippers can be permanently sealed above or below the recloseable zipper in such a manner that the opening of the package becomes apparent.

However, seals which inhibit tampering may be difficult for the consumer to open. Such seals may require the consumer to break the seals by cutting them with a scissors or knife. To overcome this problem, a tear bead or guide can be combined with a recloseable zipper to provide a package which is easy for the consumer to open and reseal and yet minimizes the opportunities for undetected pre-sale product tampering.

Existing tear guides are often inadequate because they expose the food products within the package to air outside the package, thereby defeating the purpose of the hermetic seals around the periphery of the package. Such exposure to air can degrade the quality of the food product within the package. Furthermore, existing tear guides often fail to cleanly open the package because the tear guide will deviate from a straight path across the mouth end of the package. In some cases, the tear guide will wander off the package prior to traversing the entire mouth end such that the tear guide fails to fully open the package.

A need therefore exists for an easy open header arrangement for a polymeric package which overcomes the aforementioned shortcomings often associated with existing packages.

SUMMARY OF THE INVENTION

In one particular embodiment, these and other objects are realized by providing a package header arrangement which has a header with first and second opposing films, a tear bead and a support member. The support member is attached to the first film below the tear bead. The tear bead is disposed between the first and second films. When heat and pressure are applied to the first and second films in proximity to the tear bead, the tear bead scores the first and second films creating a breakable tear bead line coincident with the tear bead. The tear bead pushes aside the inner layer of the first and second films, weakening the film along the breakable tear bead line without harming the hermetic seal provided by the films. The breakable tear bead line tears easily because it does not have the tough, flexible inner layer of the films to aid in tear resistance. The breakable tear bead line also provides an even tear along a straight line. The support member provides support while tearing along the breakable tear bead line.

BRIEF DESCRIPTION OF THE DRAWINGS

Other objects and advantages of the invention will become apparent upon reading the following detailed description and upon reference to the drawings in which.

Figure 2:
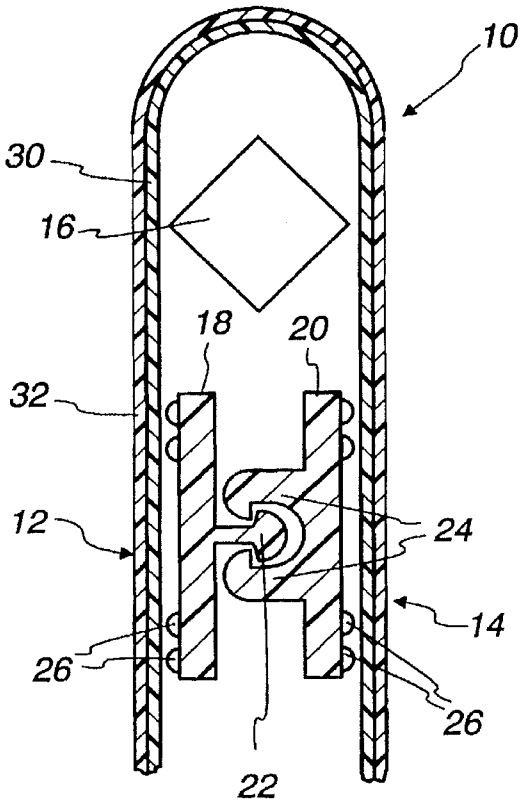
FIG. 2 is an exploded sectional view of the package header arrangement prior to attaching the tear bead and recloseable zipper to the opposing films of the package.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 1:
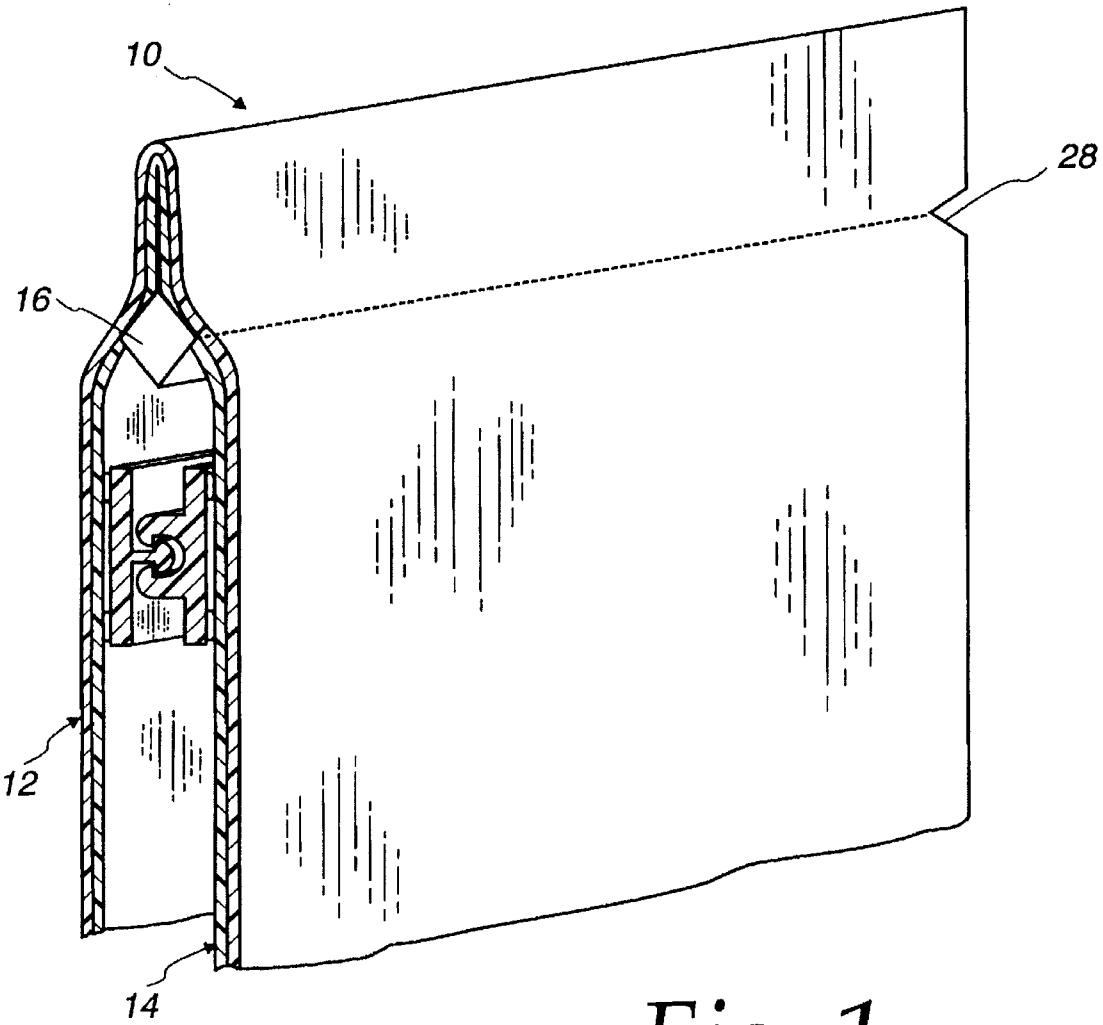
FIG. 1 is a perspective view of an easy open package header arrangement embodying the present invention, with one of the side edges of the package broken away to reveal the internal structure of the package header arrangement.

Turning now to the drawings, analogous elements will be identified by the same reference numerals throughout the figures. FIG. 1 depicts an easy open package header arrangement 10 according to one embodiment of the present invention. As shown in FIG. 1, the easy open package header arrangement 10 extends along the length of the mouth end of a package, and is used to open the package from its hermetically sealed form. FIG. 2 shows an exploded sectional view of the package header arrangement 10 in FIG. 1 prior to attaching the internal structure to opposing films 12 and 14 of the package. The package header arrangement 10 generally includes the opposing films 12 and 14, a tear bead 16, support members 18 and 20, interlocking members 22 and 24, sealant ribs 26, and a notch 28 (see FIG. 1).

Figures 3, 4, 5:
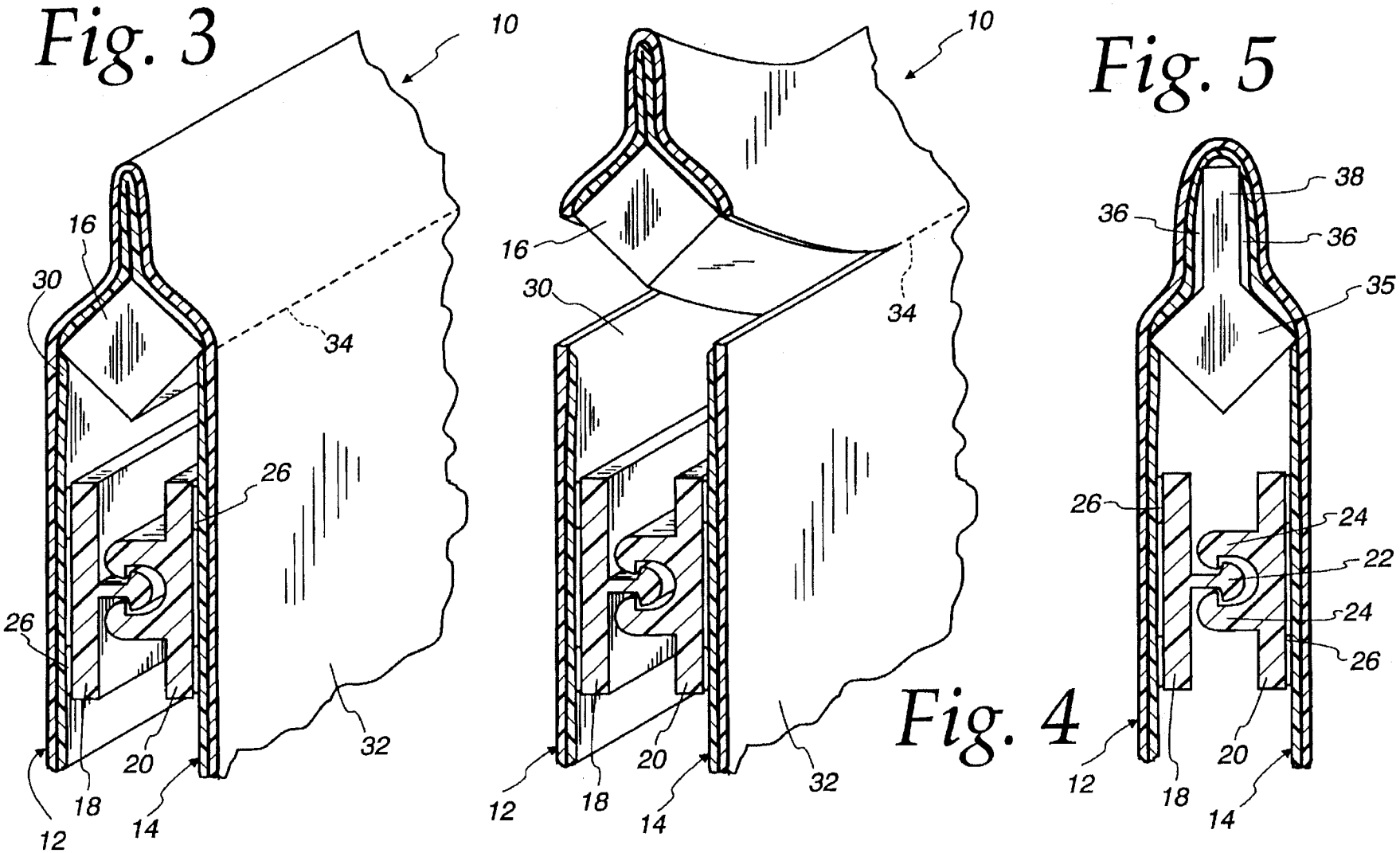
FIG. 3 is an enlarged perspective view of the package header arrangement in FIG. 1, prior to removing the top portion of the package header arrangement.
FIG. 4 is an enlarged perspective view of the package header arrangement in FIG. 1, showing the top portion of the package header arrangement being removed.
FIG. 5 is a sectional view of a modified package header arrangement.

Referring to FIGS. 2–4, the opposing films 12 and 14 each have an inner sealant layer 30 and one or more outer barrier layers 32. The inner layer 30 is preferably composed of a sealant material characterized by good toughness and flexibility, low-temperature impact resistance, clarity in film form, and relatively low heat resistance. One such material is low-density polyethylene (LDPE) or low-density polyethylene blended with ethylene vinyl acetate (EVA). The outer layer 32 is preferably composed of one or more barrier materials characterized by higher toughness, stiffness, and heat resistance as compared to the inner layer 30. Examples of materials which may be incorporated in the outer layer 32 include polypropylene, polyester, nylon, or polyethylene terephthalates (PET). Although the outer layer 32 has relatively high strengths, it can tear easily in the absence of the inner layer 30. Combining the inner and outer layers 30 and 32 creates a combination which resists stretching, abrasion and tearing. The top edge of the header arrangement 10 is formed by folding a single film in half to create the opposing films 12 and 14 or by sealing top portions of separate opposing films 12 and 14 together. The side edges of the header arrangement 10 are hermetically sealed together.

The tear bead 16 is disposed between the opposing films 12 and 14 and is attached to the films 12 and 14 above tear bead line 34, and the films 12 and 14 are attached to each other above the tear bead 16 (FIGS. 3 and 4). The tear bead 16 preferably has sharp edges, which may be provided by a diamond-shaped cross-section. The tear bead 16 is substantially composed of an extrudable material characterized by higher rigidity and tensile strength as compared to the inner layer 30 of the films 12 and 14. Also, the extrudable material of the tear bead 16 is preferably resistant to deformation under the heat and pressure used to seal the header arrangement 10. Exemplary polymers which may be incorporated in the tear bead 16 include high-density polyethylene (HDPE) or polypropylene. When pressure and heat are applied to the films 12 and 14 in proximity to the tear bead 16, the tear bead 16 scores the films 12 and 14 creating a breakable tear bead line 34 as shown in FIG. 3 which illustrates the scored films. When pressure and heat are applied, the tear bead 16 pushes aside the inner layer 30 of the films 12 and 14, weakening the film along the breakable tear bead line 34 without harming the hermetic seal provided by the films 12 and 14. FIG. 3 illustrates the tear bead 16 and the scored inner layer 30 of the films 12 and 14.

Scoring the inner layer 30 of the films 12 and 14 with the tear bead 16 reduces the tear resistance of the films along the breakable tear bead line 34 by a predetermined percentage sufficient to facilitate tearing of the films 12 and 14 along the breakable tear bead line 34. The scored films 12 and 14 tear easily along the breakable tear bead line 34 because they do not have the tough, flexible inner layer 30 of the films to aid in tear resistance. The breakable tear bead fine 34 provides an even tear along a straight line.

The support members 18 and 20 are attached to the respective films 12 and 14 below the tear bead 16 to provide support while tearing along the breakable tear bead line 34. The support members 18 and 20 add body to the header arrangement 10 and provide rigid support for easy removal of the top portion of the header arrangement 10 as depicted in FIG. 4. The support members 18 and 20 are generally rectangular in cross-sectional shape, are generally parallel to each other, and are positioned between the opposing films 12 and 14 of the header arrangement 10. The support members 18 and 20 are substantially composed of a resilient polymeric material such as low-density polyethylene.

The sealant ribs 26 firmly attach the support members 18 and 20 to the respective films 12 and 14. Specifically, the sealant ribs 26 firmly attach the outer surface of the support member 18 to the inner layer 30 of the film 12, and attach the outer surface of the support member 20 to the inner layer 30 of the film 14. The sealant ribs 26 are substantially composed of a sealant polymeric material, such as ethylene vinyl acetate, which bonds readily to other polymeric materials at low temperatures. Alternatively, the support members 18 and 20 may be thermally fused directly to the respective films 12 and 14 by use of higher temperatures, greater pressure and/or greater dwell time of conventional heat seal bars during the heat sealing process.

FIG. 4 shows the top portion of the header arrangement 10 in the process of being removed. To remove the top portion of the header arrangement 10, the bond along the breakable tear bead line 34 is broken. The user grasps the films 12 and 14 above the tear bead 16 and pulls the top portion of the header arrangement 10 in a direction generally opposite to the portion of the header arrangement 10 below the tear bead line 34 while holding on to this header portion below the tear bead line 34. With respect to the illustrated header arrangement 10 in FIG. 4, the direction of the opening force applied to the top portion of the header arrangement 10 is both upward and to the right.

To facilitate commencement of the breaking of the breakable tear bead line 34, the opposing films 12 and 14 of the header arrangement 10 preferably form the minute notch 28 (FIG. 1) along one or both of the opposing side edges of the header arrangement 10 at a location adjacent to one end of the tear bead 16.

As depicted in FIG. 4, detaching the top portion of the header arrangement 10 generally ruptures the films 12 and 14 along the breakable tear bead line 34 to open the package from a hermetically sealed form. The notch 28 (see FIG. 1) formed in the side edge of the header arrangement 10 initiates this rupture of the films 12 and 14. The scored inner layer 30 of the films assists the top portion of the header arrangement 10, including the tear bead 16, in separating clearly along the breakable tear bead line 34 from the lower portion of the header arrangement 10.

Referring back to FIG. 2, the package header arrangement 10 is optionally provided with a conventional recloseable zipper to permit repeated opening and closing of the package after the top portion of the header arrangement 10 has been removed. More specifically, a male locking member 22 is integrally formed with and extends inwardly from the support member 18. A pair of female locking members 24 are integrally formed with and extend inwardly from the support member 20 toward the support member 18. These female locking members 24 form a groove therebetween for receiving the locking member 22. The male and female locking members 22 and 24 are preferably composed of the same resilient material, e.g., low-density polyethylene, used to form the support members 18 and 20.

After initially tearing open the header arrangement 10, the recloseable zipper is closed, as depicted in FIG. 4, with the male and female locking members 22 and 24 interlocked to each other. To open the package and gain access to the contents thereof, the interlocked male and female members 22 and 24 are disengaged from each other by grabbing onto the opposing films 12 and 14 near the top edges thereof and pulling them apart. To reclose the package with the zipper, the female locking members 24 are interlocked with the male locking member 22 in a snapping action caused by bringing hooks formed by the female locking members 24 beyond an expanded head formed by the male locking member 22. The engagement of the expanded head of the male locking member 22 with the hooks of the female locking members 24 maintains the male locking member 22 in the groove formed between the female locking members 24.

The easy open package header arrangement 10 is manufactured using fairly conventional heat sealing and extrusion techniques. It suffices to state that the support members 18 and 20, the locking members 22 and 24, and the sealant ribs 26 may be coextruded through a single die fed by a plurality of extruders containing the various polymeric materials forming the aforementioned elements of the package header arrangement 10. The die configures the melted polymeric materials fed thereto by the extruders into the shapes depicted in FIG. 2. The melted polymeric materials exit the die with the illustrated attachments. Alternatively, the male closure profile (including the support member 18, the male locking member 22, and the associated sealant ribs 26) may be coextruded through one die, while the female closure profile (including the support member 20, the female locking members 24, and the associated sealant ribs 26) are coextruded through another die. As the tear guide 16 is not attached to the support members 18 and 20, the locking members 22 and 24, or the sealant ribs 26, the tear guide 16 may be extruded separately from these elements using a separate die.

After extruding the internal elements of the package header arrangement 10 as described above, these internal elements are thermally fused between the opposing films 12 and 14. In particular, the support member 18 is thermally fused to the film 12 by the sealant ribs 26, and the support member 20 is thermally fused to the film 14 by the sealant ribs 26. Also, the tear bead 16 is thermally fused to the inner layer 30 of the films 12 and 14 by applying heat and pressure to the films immediately adjacent to the tear bead 16 for a predetermined dwell time using one or more heated seal bars. The temperature, pressure, and dwell time of the seal bars is selected such that the tear bead 16 creates a score in the inner layer 30 of the films 12 and 14. In addition to thermally fusing the internal elements of the package header arrangement 10 between the opposing films 12 and 14, the films 12 and 14 are thermally fused together above the tear bead 16.

In one embodiment, the tear bead 16 is thermally fused between the opposing films 12 and 14 using heated seal bars which apply a pressure of approximately 50 pounds per square inch at a temperature of approximately 180 degrees Fahrenheit for a dwell time of approximately 1.0 seconds. It has been found that this pressure, temperature, and dwell time allows the tear bead 16 to "push aside" or score the inner sealant layer 30 of the opposing films 12 and 14, while leaving the outer barrier layer 32 intact. Scoring the films 12 and 14 makes the breakable tear bead line 34 approximately 10 to 30 percent less tear resistant than non-scored portions of the films 12 and 14.

FIG. 5 is a sectional view of a modified easy open package header arrangement embodying the present invention. As shown in FIG. 5, the package header arrangement comprises opposing films 12 and 14, a tear bead 35, support members 18 and 20, interlocking members 22 and 24, and sealant material 26 and 36. The second embodiment is substantially similar to the embodiment in FIG. 1 except the tear bead 35 is connected to an upper flange 38. FIG. 5 shows the flange 38 integrally formed with and extending upward from the tear bead 35. The flange 38 may be composed of the same material as the tear bead 35, i.e., high-density polyethylene or polypropylene, or, alternatively, may be substantially composed of a resilient polymeric material such as low-density polyethylene. The sealant material 36 attaches the flange 38 to the respective films 12 and 14.

To remove the top portion of the header arrangement, the bond along the breakable tear bead line formed by the tear bead 35 is broken. The user grasps and pulls the top portion of the header arrangement above the tear bead 35 in a direction generally opposite to the lower portion of the header arrangement below the tear bead 35 while holding on to this lower portion. The upper flange 38 aids in grasping and pulling of the top portion of the header arrangement. The applied force causes the opposing films 12 and 14 to rupture along the breakable tear bead line such that the top portion of the header arrangement, including the tear bead 35 and flange 38, breaks away from the remainder of the package.

Figure 6:
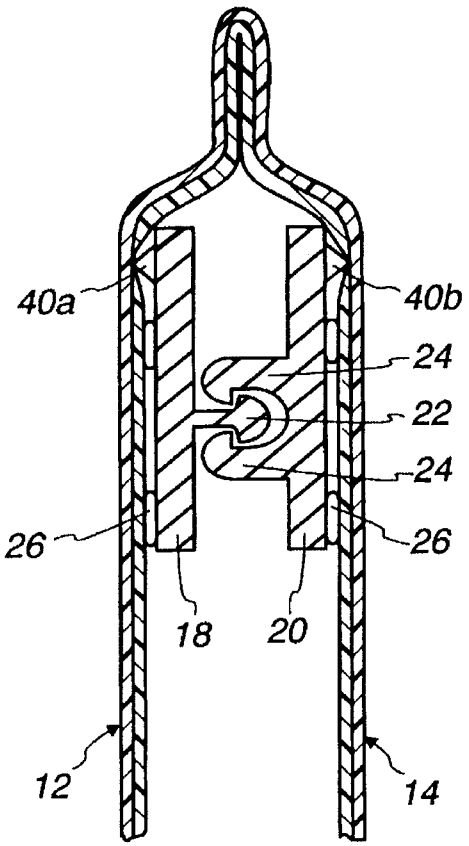
FIG. 6 is a sectional view of a further modified package header arrangement.

Another embodiment of the easy open package header arrangement is illustrated by FIG. 6. As shown in FIG. 6, the package header arrangement comprises opposing films 12 and 14, left and fight portions **40*a* and 40*b* of a tear bead, support members 18 and 20, interlocking members 22 and 24, and sealant material 26. The left portion 40*a* of the tear bead is integrally formed with the support member 18 and extends outward toward the film 12. The right portion 40*b* of the tear bead is integrally formed with the support member 20 and extends outward toward the film 14. The left and right portions 40*a* and 40*b* of the tear bead perform the same scoring function as the tear bead in the prior embodiments to create a breakable tear line. The left and right portions 40*a* and 40*b* of the tear bead preferably are formed of high density polyethylene or polypropylene and are formed integrally with support members 18 and 20** respectively, which preferably are formed from low density polyethylene.

The sealant material 26 attaches the support members 18 and 20 to the respective films 12 and 14. The sealant material 26 firmly attaches the inner surface of the film 12 to the support member 18 below the left portion **40*a* of the tear bead, while the support member 20 is attached to the inner surface of the film 14 below the right portion 40*b* of the tear bead. The portions of the support members 18 and 20 above the respective left and right portions 40*a* and 40*b* of the tear bead are not attached to the films 12 and 14**.

To remove the top portion of the header arrangement, the bond along the breakable tear bead line is broken. The user grasps and pulls the films 12 and 14 of the top portion of the header arrangement above the tear bead portions **40*a* and 40*b* in a direction generally opposite to the lower portion of the header arrangement below the tear bead portions 40*a* and 40*b* while holding on to this lower portion. In this case the films 12 and 14 rupture immediately adjacent to the left and right tear bead portions 40*a* and 40*b*. A tear support (not shown) may be attached between the films 12 and 14 above the support members 18 and 20** to supply a substantial element to gasp and pull when removing the top portion of the header arrangement.

Figure 7:
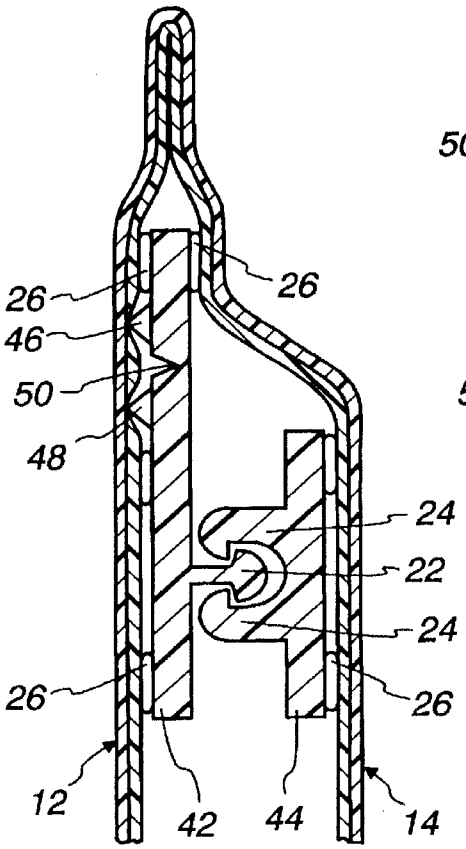
FIG. 7 is a sectional view of yet a further modified package header arrangement.

FIG. 7 is a sectional view of yet another embodiment of the easy open package header arrangement. As shown in FIG. 7, the package header arrangement comprises opposing films 12 and 14, base strips or support members 42 and 44, tear beads 46 and 48, interlocking members 22 and 24, sealant material 26, and one or more die lines 50. In this embodiment the tear beads 46 and 48 replace the tear beads of the previous embodiments. The base strip 42 extends further upward into the top portion of the header arrangement than does the base strip 44. The base strips 42 and 44 are generally rectangular in cross-sectional shape and are substantially composed of a resilient polymeric material such as low-density polyethylene. The base strips 42 and 44 are generally parallel to each other and are positioned between the opposing films 12 and 14 of the header arrangement.

The tear beads 46 and 48 are integrally formed with the base strip 42 and point outward toward the film 12. The tear bead 46 is located above tear bead 48 on the base strip 42. The tear beads 46 and 48 are substantially composed of an extrudable material, such as high-density polyethylene or polypropylene, which will not deform under the heat and pressure used to seal the header arrangement. When heat and pressure are applied to the films 12 and 14 in proximity to the tear beads 46 and 48, the tear beads 46 and 48 score the film 12 to create a pair of spaced breakable tear bead lines 56 and 58 (FIG. 9).

Figure 8:
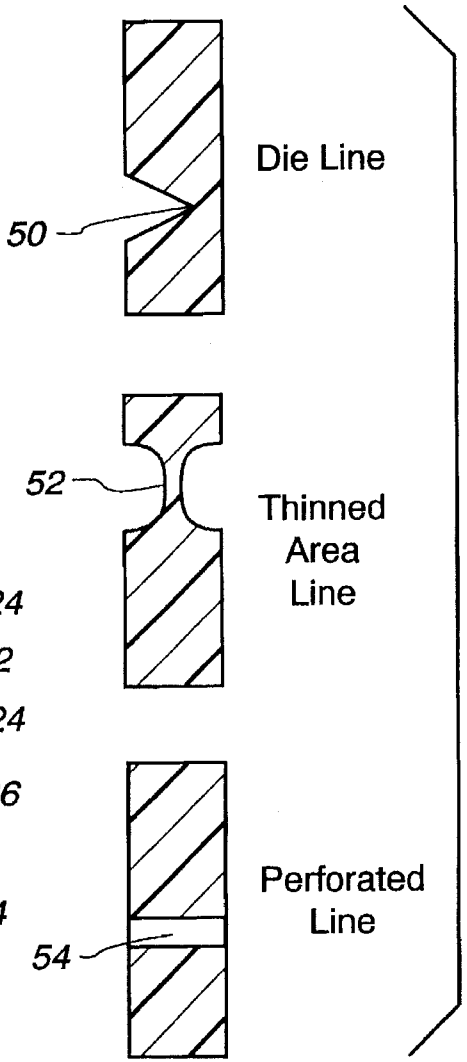
FIG. 8 is a sectional view of various means for weakening a support member, including a die line, thinned area line, and perforated line.

One or more die lines 50 are formed in the base strip 42 between the tear beads 46 and 48. Alternatively, as shown in FIG. 8, one or more thinned area lines 52 or perforated lines 54 may be cut into the base strip 42 between the tear beads 46 and 48 in place of the die line 50.

The sealant material 26 attaches the outer surfaces of base strips 42 and 44 to the respective films 12 and 14 and the inner surface of base strip 42 to film 14. The sealant material 26 firmly attaches the inner surface of the film 12 to the base strip 42 above the tear bead 46 and below the tear bead 48, while the base strip 44 is attached to the inner surface of the film 14.

Figure 9:
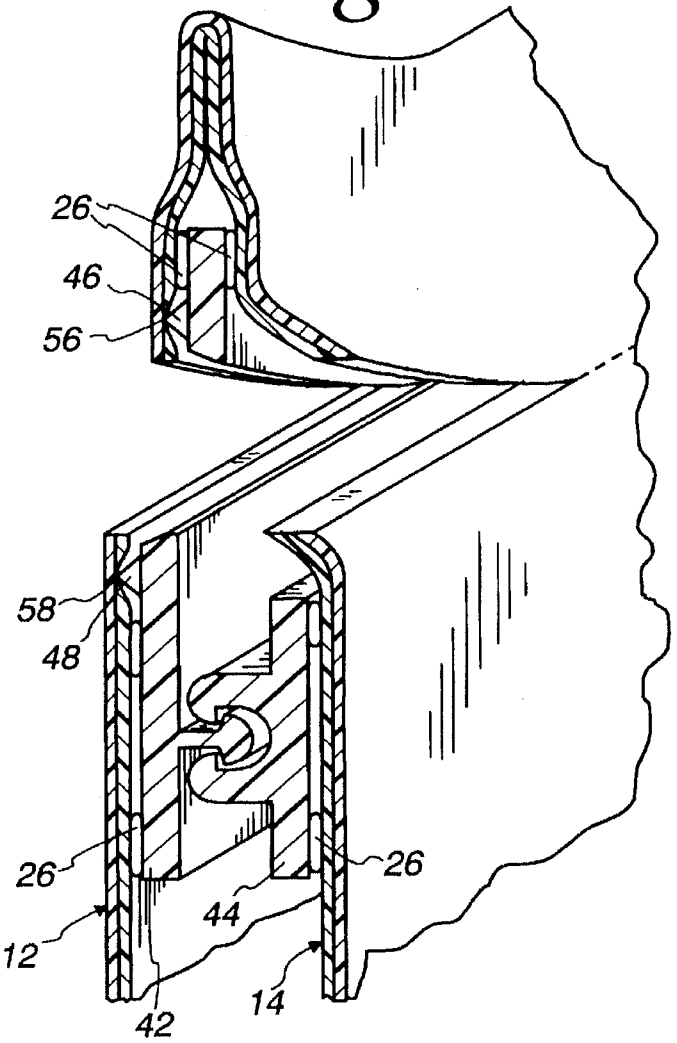
FIG. 9 is a perspective view of the package header arrangement in FIG. 7 showing the top potion of the package header arrangement being removed.

To remove the top portion of the header arrangement, the opposing films 12 and 14 along with the base strip 42 rupture between the breakable tear bead lines 56 and 58 as shown in FIG. 9. The user grasps and pulls the top portion of the header arrangement above the tear beads 46 and 48 in a direction generally opposite to the lower portion of the header arrangement below the tear beads 46 and 48 while holding on to this lower portion. The rupture begins at a notch located at a side edge of the package (see FIG. 1) and continues between the breakable tear bead lines 56 and 58. The breakable tear bead lines 56 and 58 serve as guides to prevent the tear from deviating above the tear bead line 56 or below the tear bead line 58. That is, the tear is confined between the tear bead lines 56 and 58. The base strip 42 tears in proximity to the die line 50.

Figure 10:
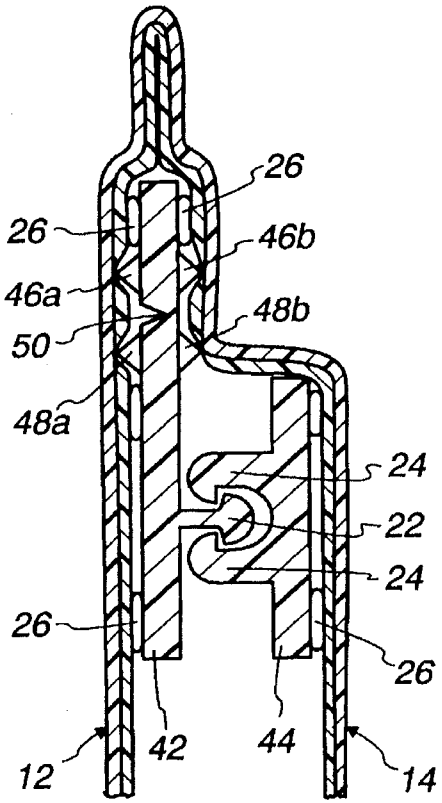
FIG. 10 is a sectional view of yet another modified package header arrangement.

FIG. 10 illustrates another embodiment of the easy open package header arrangement with tear beads. As shown in FIG. 10, the package header arrangement comprises opposing films 12 and 14, base strips or support members 42 and 44, tear beads **46*a*, 46*b*, 48*a*, and 48*b*, interlocking members 22 and 24, sealant material 26, and one or more die lines 50. In this embodiment the tear beads 46*b* and 48*b* are used to score the film 14. The tear beads 46*b* and 48*b* are integrally formed with the base strip 42 and point outward toward the film 14. The tear bead 46*b* is located above the tear bead 48*b* on the base strip 42. When heat and pressure are applied to the films 12 and 14 in proximity to the tear beads 46*a*, 46*b*, 48*a*, and 46*b*, the tear beads 46*a* and 46*b* score the respective films 12 and 14 creating a first breakable tear bead line; and the tear beads 48*a* and 48*b* score the respective films 12 and 14** creating a second breakable tear bead line below the first breakable tear bead line.

To remove the top portion of the header arrangement, the films 12 and 14 rupture between the spaced breakable tear bead lines in response to proper grasping and pulling by a user. The base strip 42 tears in proximity to the die line 50. The die line 50 may, of course, be replaced with a thinned area line or perforated line of the type depicted in FIG. 8.

Figure 11:
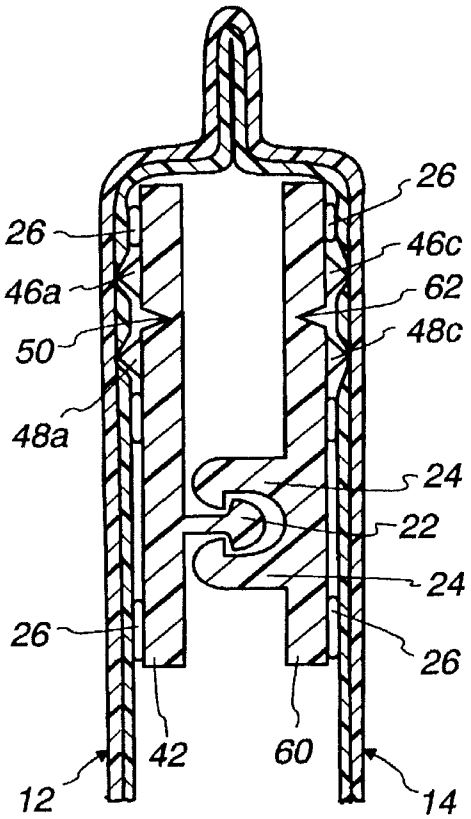
FIG. 11 is a sectional view of a further modified package header arrangement.

FIG. 11 illustrates a further embodiment of the easy open package header arrangement. As shown in FIG. 11, the package header arrangement comprises opposing films 12 and 14, base strips or support members 42 and 60, tear beads **46*a*, 46*c*, 48*a*, and 48*c*, interlocking members 22 and 24, sealant material 26, and die lines 50 and 62. In this embodiment the base strip 60 differs from the base strip 44 in FIG. 10 in that the base strip 50 extends further upward into the top portion of the header arrangement. The tear beads 46*a* and 48*a* are integrally formed with the base strip 42 and point outward toward the film 12, while the tear beads 46*c* and 48*c* are integrally formed with the base strip 60 and point outward toward the film 14. A die line 50 is formed in the base strip 42 between the tear beads 46*a* and 48*a*, and a die line 62 is formed in the base strip 60 between the tear beads 46*c* and 48*c***.

In response to a user grasping and pulling a top portion of the header arrangement relative to a lower portion thereof, the films 12 and 14 tear between the breakable tear bead lines created by the tear beads. Additionally, the base strip 42 tears in proximity to the die line 50, and the base strip 60 tears in proximity to the die line 62.

Figure 12:
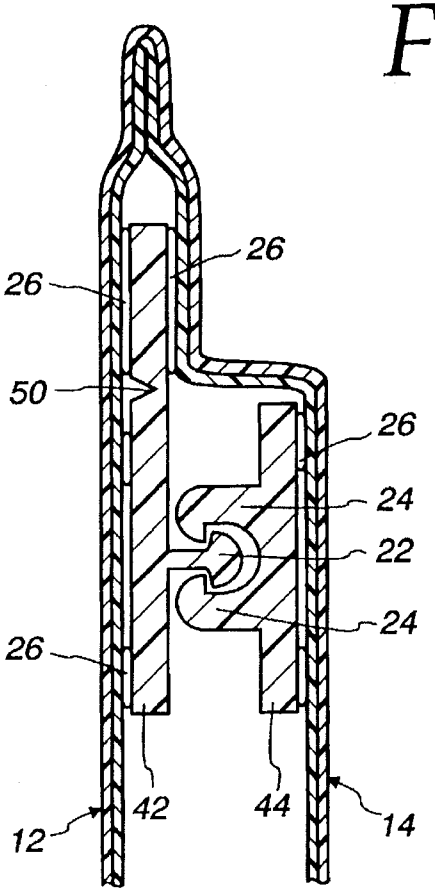
FIG. 12 is a sectional view of yet a further modified package header arrangement.

FIG. 12 illustrates yet a further embodiment of an easy open package header arrangement. As shown in FIG. 12, the package header arrangement comprises opposing films 12 and 14, base strips 42 and 44, interlocking members 22 and 24, sealant material 26, and a die line 50. This embodiment differs from the previous embodiments because it does not contain a tear bead.

The base strip 42 extends further upward into the top portion of the header arrangement than does the base strip 44. One or more die lines 50 are formed in the upper portion of the base strip 42. Alternatives to the die line 50 include a thinned area line 52 and a perforated line 54 of the type shown in FIG. 8. A plurality of die lines, thinned area lines or perforated lines may be formed in the base strip 42. The sealant material 26 firmly attaches the portion of the base strip 42 below the die line 40 to the inner surface of the film 12, while the base strip 44 is attached to the inner surface of the film 14. The sealant material 26 also attaches the films 12 and 14 to the upper portion of the base strip 42 above the die line 50.

To remove the top portion of the header arrangement, the films 12 and 14 and the base strip 42 are ruptured in closed proximity to the die line 50. A user grasps and pulls the top portion of the header arrangement in a direction generally opposite to the lower portion thereof while holding on to the lower portion. The application of this opening force ruptures the films 12 and 14 and the base strip 42 along the die line 50 to open the package from a hermetically sealed form. A notch formed in the side edge of the package (see FIG. 1) initiates this rupture of the films 12 and 14. After the top portion of the header arrangement is removed, the recloseable zipper may be used to reseat the package.

Figure 14:
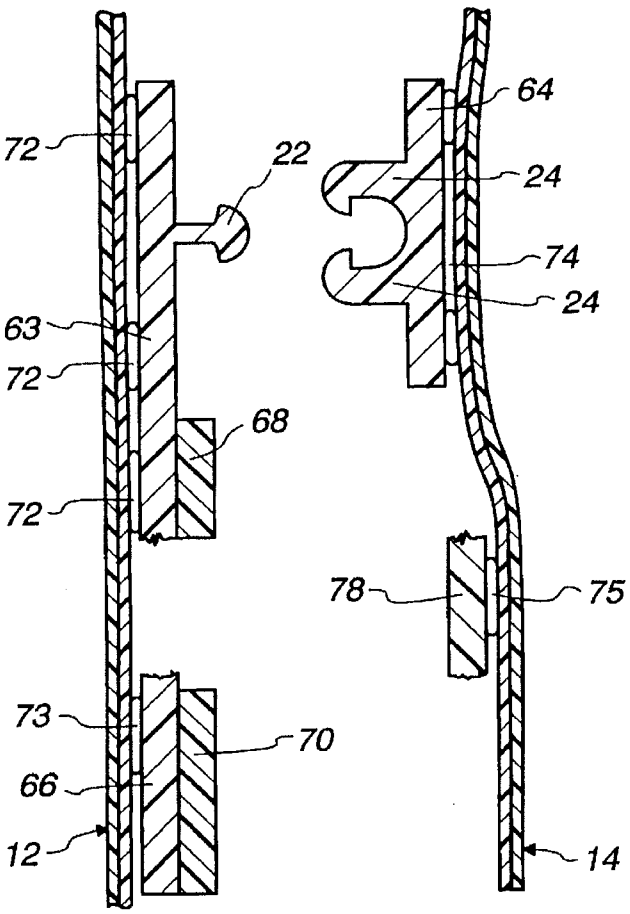
FIG. 14 is a sectional view of the package header arrangement in FIG. 13 after the package has been opened.
Figure 13:
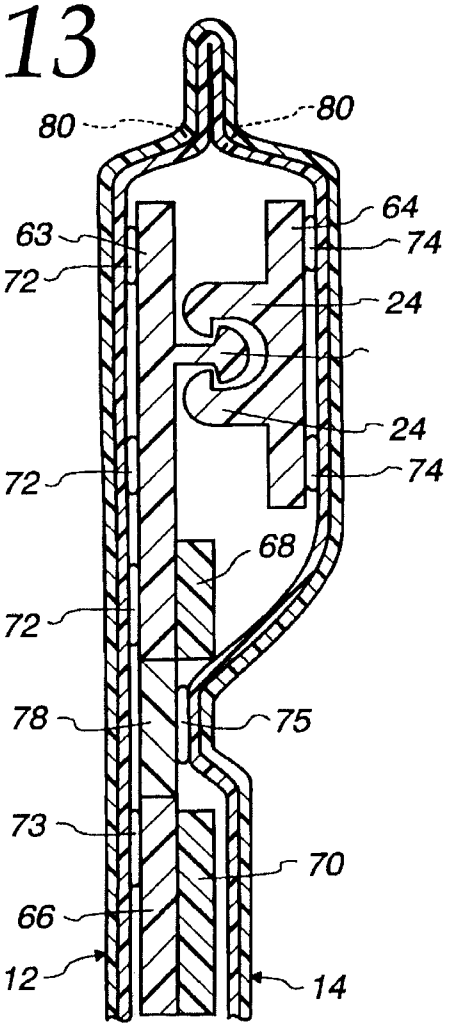
FIG. 13 is a sectional view of another modified package header arrangement prior to opening the package.

FIGS. 13 and 14 illustrate sectional views of an additional embodiment of an easy open package header arrangement. The arrangement includes opposing films 12 and 14, a plurality of flat base strips 63, 64, and 66, a pair of flat heat-resistant (non-sealant) strips 68 and 70, a plurality of sealant strips 72–75, a breakaway strip 78, interlocking members 22 and 24, and one or more perforated lines 80.

The film 12 is thermally fused to the outer surface of the base strip 63 by the sealant strips 72 and is thermally fused to the outer surface of the base strip 66 by the sealant strip 73. The film 14 is thermally fused to the outer surface of the base strip 64 by the sealant strip 74 and is thermally fused to the breakaway strip 78 by the sealant strip 75. The breakaway strip 78 is disposed between the spaced base strips 63 and 66 and is releasably engaged thereto so as to form breakaway seals at the junctions between the breakaway strip 78 and the respective base strips 63 and 66. More specifically, an upper side of the breakaway strip 78 is detachably connected to the base strip 63 to form a first breakaway seal and the opposing lower side of the breakaway strip 78 is detachably connected to the base strip 66 to form a second breakaway seal. To permit these breakaway seals to be broken as depicted in FIG. 14, the inner surface of the breakaway strip 78 is indirectly attached to the film 14 through the sealant strip 75.

One or more perforated lines 80 are cut into the films 12 and 14 to provide a means to easily rupture the films 12 and 14. Alternatively, a die line or thinned area line of the type shown in FIG. 8 may be used in place of the perforated line 80. The easy open package header arrangement is optionally provided with a conventional recloseable zipper to permit repeated opening and closing of the package after the top portion of the header arrangement is removed.

To open the header arrangement, the top portion of the header arrangement is removed by tearing films 12 and 14 along the perforated line 80. Next, the interlocking members 22 and 24 are detached from each other by grasping onto the films 12 and 14 and pulling them apart. Finally, the breakaway seals between the breakaway strip 78 and the base strips 63 and 66 are broken by continuing to pull the films 12 and 14 in opposite directions. During breakage of these breakaway seals, the base strip 63 and the base strip 66 remain attached to the film 12, while the base strip 64 and the breakaway strip 78 remain attached to the film 14.

The breakaway strip 78 and flat non-sealant strips 68 and 70 are substantially composed of an extrudable material such as high-density polyethylene or polypropylene. The base strips 63, 64, and 66 are substantially composed of a resilient polymeric material such as low-density polyethylene. The sealant strips 72–75 are substantially composed of a sealant polymeric material, such as ethylene vinyl acetate, which bonds readily to other polymeric materials at low temperatures.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A package header arrangement comprising:

a header with first and second opposing films;

a first base strip disposed between said first and second opposing films, said first base strip having an inner and outer surface, said outer surface being attached to said first film;

a first tear bead located on said first base strip, said first tear bead abutting an inner surface of said first film, said first film having a first score line located adjacent to, and coextensive with, said first tear bead; and a second tear bead located on said first base strip below said first tear bead, said second tear bead abutting the inner surface of said first film, said first film having a second score line located adjacent to, and coextensive with, said second tear bead.

2. The package header arrangement of claim 1, further including a third tear bead located on said first base strip, said third tear bead abutting an inner surface of said second film, said second film having a third score line located adjacent to, and coextensive with, said third tear bead; and a fourth tear bead located on said first base strip below said third tear bead, said fourth tear bead abutting the inner surface of said second film, said second film having a fourth score line located adjacent to, and coextensive with, said fourth tear bead.

3. The package header arrangement of claim 1, further including a second base strip opposing said first base strip, said second base strip disposed between said first base strip and said second film, said second base strip having an inner and outer surface, said outer surface attached to said second film;

a third tear bead located on said second base strip, said third tear bead abutting an inner surface of said second film, said second film having a third score line located adjacent to, and coextensive with, said third tear bead; and a fourth tear bead located on said second base strip below said third tear bead, said fourth tear bead abutting the inner surface of said second film, said second film having a fourth score line located adjacent to, and coextensive with, said fourth tear bead.

4. The package header arrangement of claim 1, further including a notch on an edge of said first base strip between said first and second tear beads for starting a tear between said first score line and said second score line.

5. The package header arrangement of claim 1, further including a second base strip opposing said base strip and attached to said second film;

a first locking member extending inwardly from said first base strip toward said second base strip and a second locking member extending inwardly from said second base strip toward said first base strip, said first and second locking members being releasably engageable.

6. The package header arrangement of claim 1, wherein said first and second films each include inner and outer layers, said inner layer including low-density polyethylene.

7. The package header arrangement of claim 1, wherein said first and second tear beads include high-density polyethylene.

8. The package header arrangement of claim 1, further including a sealant material disposed on said inner and outer surfaces of said first base strip above said tear bead for sealing said first and second films to said first base strip, wherein said sealant includes ethylene vinyl acetate.

9. The package header arrangement of claim 1, further including means on said first base strip for guiding a tear between said first score line and said second score line.

10. The package header arrangement of claim 9, wherein said means for guiding comprises a perforated line along said first base strip between said first and second tear beads.

11. The package header arrangement of claim 9, wherein said means for guiding comprises a die line along said first base strip between said first and second tear beads.

12. The package header arrangement of claim 9, wherein said means for guiding comprises a thinned area line along said first base strip between said first and second tear beads.

* * * * *